US007413477B2

(12) United States Patent
Autio et al.

(10) Patent No.: US 7,413,477 B2
(45) Date of Patent: Aug. 19, 2008

(54) POWER PLUG WITH PROGRAMMABLE FUNCTIONALITY

(75) Inventors: Craig R. Autio, Orange, MA (US); Michael Batten, Westminster, MA (US)

(73) Assignee: The Whistler Group, Inc., Chelmsford, MA (US)

( * ) Notice: Subject to any disclaimer, the term of this patent is extended or adjusted under 35 U.S.C. 154(b) by 164 days.

(21) Appl. No.: 11/194,227

(22) Filed: Aug. 1, 2005

(65) Prior Publication Data

US 2007/0026741 A1 Feb. 1, 2007

(51) Int. Cl.
*H01R 24/04* (2006.01)

(52) U.S. Cl. ..... 439/668; 439/620.21

(58) Field of Classification Search ..... 439/668, 439/620.21

See application file for complete search history.

(56) References Cited

U.S. PATENT DOCUMENTS 4,604,529 A 8/1986 Grimsley et al.
5,199,904 A * 4/1993 Wharton ..... 439/668
5,569,053 A * 10/1996 Nelson et al. ..... 439/668
5,903,135 A * 5/1999 Posses et al. ..... 320/114
6,551,142 B2 * 4/2003 Eisenbraun ..... 439/668
2005/0143880 A1 * 6/2005 Schedevy ..... 701/24
2007/0015537 A1 * 1/2007 DeBiasio et al. ..... 455/556.1

* cited by examiner

*Primary Examiner*—Michael C Zarroli
(74) *Attorney, Agent, or Firm*—David W. Carstens; Carstens & Caboon, LLP

(57) ABSTRACT

The present invention provides a power plug for insertion into a cigarette lighter socket for powering an electronic device. The invention includes a housing and electrical contacts and a two-conductor cable coupled to the housing for supplying power to the electronic device. An electronic circuit inside the housing controls power to the electronic device, and a switch coupled to the housing controls one or more programmable functions of the electronic device. The particular function controlled by the switch depends on the length of time the switch is depressed (e.g., greater or less then 0.5 second).

18 Claims, 6 Drawing Sheets

POWER PLUG WITH PROGRAMMABLE FUNCTIONALITY

TECHNICAL FIELD

The present invention relates to power plug for electronic devices that utilizes a cigarette lighter socket for power, and more specifically a power plug that incorporates a switch that is programmable for functions related to the electronic device.

BACKGROUND OF THE INVENTION

Many electronic devices are available for use in automobiles. In addition to built-in devices, such as stereo systems, other devices (e.g., CD players, MP3 players, video players, police radar detectors, navigation devices, etc.) may be used by employing a power adapter that plugs into the cigarette lighter socket of the vehicle.

When utilizing such devices, it is common to activate certain features by actuating the control switches contained on the housings of the devices. When the device is mounted on a windshield or visor, the actuation of these switches can be cumbersome. Some motor vehicles have a long, sweeping, dashboard, which forces drivers to possibly overextend their reach in order to activate the device's controls.

To overcome this problem some attempt has been made to incorporate device functions directly into the power cord. For example, one cigarette lighter plug power cord designed for use with a radar detector contains an alert LED, and a power LED on the plug housing and a dedicated switch for controlling the mute and volume functions, allowing the user to activate that function without overreaching. The cord thus provides feature convenience more accessible than utilizing the same switch on the radar detector housing itself. However, the functions that can be activated via the power cord are not programmable. Therefore, if the user desires to activate a function other than the dedicated one (e.g., mute), the user must still reach for the detector's control buttons.

Furthermore, currently available cords utilize a multi-conductor cable and a unique connector for engagement with the mating connector on their products, as depicted in FIG. 3. This four-conductor, telephone-type connector and cable serve as power, ground, LED status indicator, and mute function. A similarly configured "hardwire" kit is also available for bypassing the cigarette lighter plug and wiring the source to the fuse block or other suitable location and contains the same multi-conductor cable to mate with existing products. These cable and connector configurations are considerably more costly than the common two-conductor plug (power and ground) that are typically used for automotive power supplies for many other consumer products.

Therefore it would be desirable to have a cigarette plug power source for electronic devices that comprises a switch that is programmable for a plurality of functions and utilizes a common two-conductor plug.

SUMMARY OF THE INVENTION

The present invention provides a power plug for insertion into a cigarette lighter socket for powering an electronic device. The invention includes a housing and electrical contacts and a two-conductor cable coupled to the housing for supplying power to the electronic device. An electronic circuit inside the housing controls power to the electronic device, and a switch coupled to the housing controls one or more programmable functions of the electronic device. The particular function controlled by the switch depends on the length of time the switch is depressed (e.g., greater or less then 0.5 second).

BRIEF DESCRIPTION OF THE DRAWINGS

The novel features believed characteristic of the invention are set forth in the appended claims. The invention itself, however, as well as a preferred mode of use, further objects and advantages thereof, will best be understood by reference to the following detailed description of an illustrative embodiment when read in conjunction with the accompanying drawings, wherein:

DETAILED DESCRIPTION OF THE DRAWINGS

The following description uses the example of a police radar detector, which is one of the most common electronic devices that use a cigarette lighter socket for power. However, the present invention can be used with any electronic device (e.g., CD and MP3 players, video/DVD players, etc.) that is powered through the cigarette lighter socket and a corresponding power cable.

Figure 1:
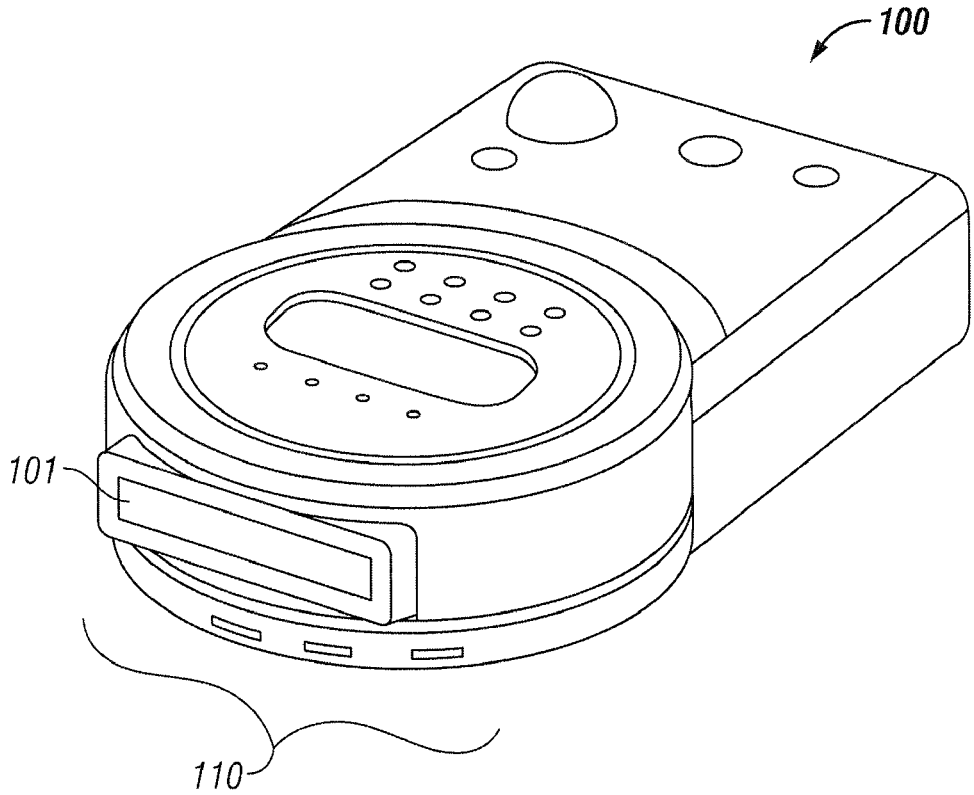
FIG. 1 depicts a typical police radar detector that may be used in the implementation of the present invention.

FIG. 1 depicts a typical police radar detector that may be used in the implementation of the present invention. The devices known in the art typically include a housing 100 that contains detection, processing, and displaying means. The housing may include a port for an external power supply. The display 101 contains light emitting diodes (LEDs), Liquid Crystal Displays (LCDs), or dot matrix full text displays. Also incorporated into the housing 100 are user controlled switches 110 for turning the device on, selecting different user settings, and engaging certain features such as Mute, Dark, Volume, and other related functions.

Figure 2:
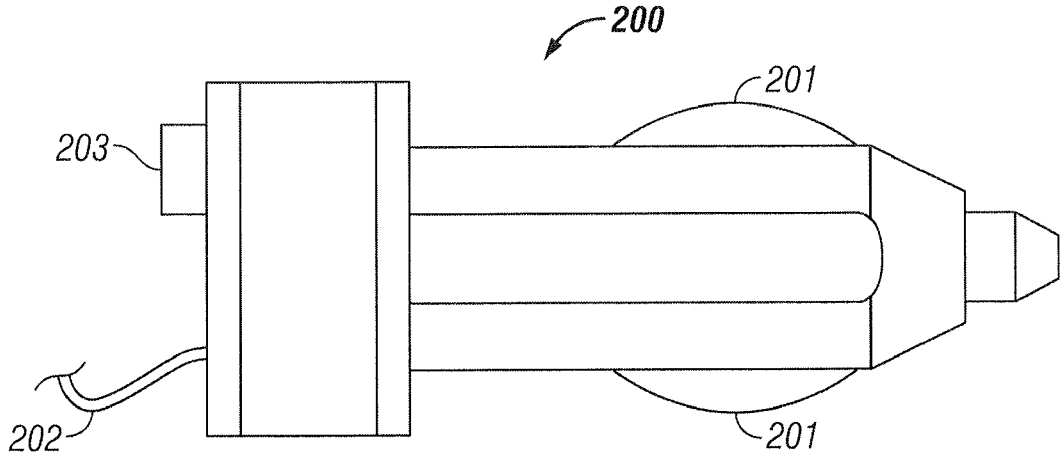
FIG. 2 depicts a side view of a cigarette lighter power plug with which the present invention may be implemented.
Figure 3:
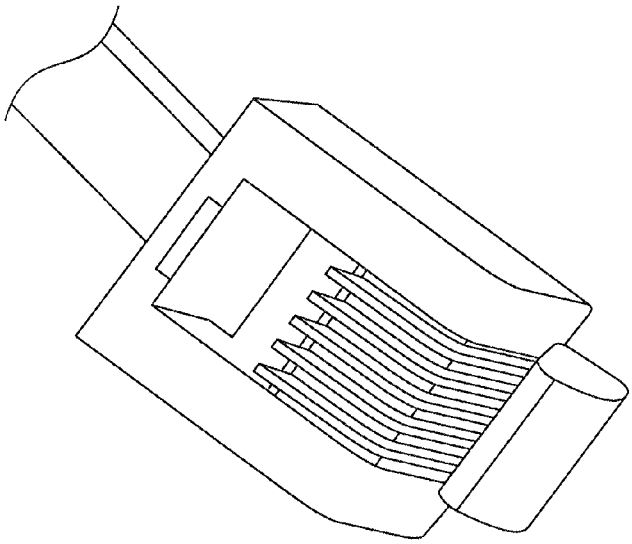
FIG. 3 shows a multi-conductor cable and connector for engagement with a radar detector in accordance with the prior art.

FIG. 2 depicts a side view of a cigarette lighter power plug with which the present invention may be implemented. The plug comprises a housing 200 that is designed to couple with a vehicle's cigarette lighter socket. The plug incorporates a metal plate having a forward end to which is coupled a pair of outwardly bowed, resilient, spring arms 201 extending exteriorly of the plug housing 200 to make electrical and physical contact with the cigarette lighter socket. A two-conductor power cord 202 extends from the other end of the plug housing, terminating in a mating configuration (not shown) for engaging a port in the detector housing. Whereas prior art devices have incorporated expensive four-conductor, telephone-type connectors and cables, such as that depicted in FIG. 3, the present invention uses the more common two-conductor cable (power and ground) that is used with most automotive devices.

Mounted on the plug housing 200 is a switch 203 whose external activation can control a plurality of programmable functions of the radar detector or other electronic device. The present invention allows this switch 203 to control at least two programmable functions on the detector, which are user defined. Activation of the switch, by a short press (e.g., ≦0.5 second) or a long press (e.g., ≧0.5 second), operates the detector as if the defined physical switch on the detector housing itself were pressed. This differentiation between short and long presses allows "remote" operation of at least two features.

Using the radar detector example, in one embodiment of the invention a short press of the POWER button turns the unit ON/OFF, whereas a long press is DIM/DARK Mode engagement. The invention also provides derivative functions, wherein a short press may have two functions depending on the momentary status of the functions when the button is actuated. For example, the QUIET button has two functions, depending on whether the unit is alarming or not at the time of actuation. If the alarm is sounding when the button is pressed quickly, the QUIET function is engaged. If the alarm is not sounding, a short press will activate the second function. A long press of the same button is also assigned a unique feature. Other buttons may operate in the same manner.

The programmability (assignment) of the functions to the power plug switch occurs at the electronic device. Continuing the example of the radar detector, one embodiment of the present invention has a "table driven" Option Mode, which is a menu driven selection feature list. For example, the first entry might be "S1—POWER", wherein S1 represents a short press. The user activates a button to scroll through the functions until reaching the function the user wants to assign to a short press (e.g., MUTE). When the user advances the menu to S2 (long press), the same selections are available. The memory chip in the radar detector stores the assignment. When power interruptions are detected (explained below), the detector looks up the characteristics of the received signal, and determines which function to perform.

The number of switches and communication protocol may be expanded to control other functions to parallel the detector's features and existing controls.

Figure 4:
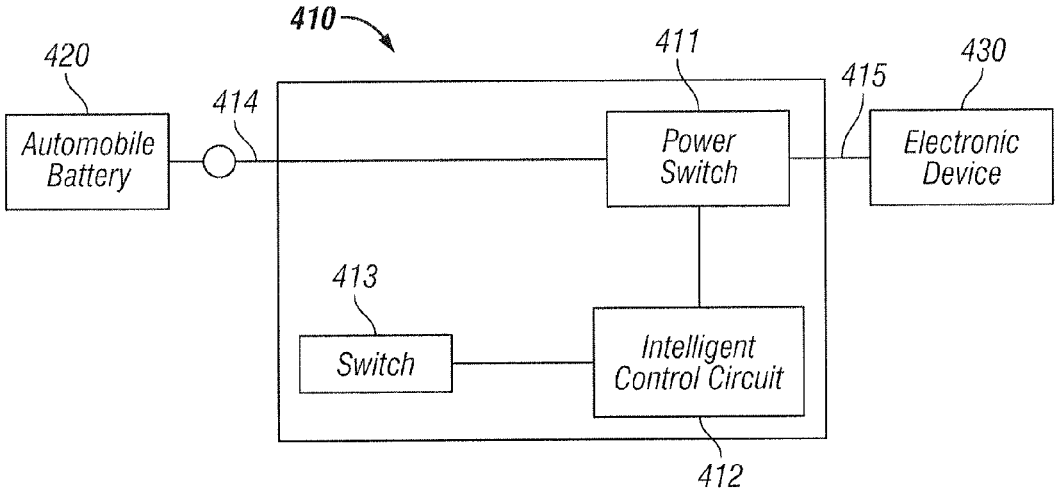
FIG. 4 depicts a block diagram of the power plug in accordance with the present invention.

FIG. 4 depicts a block diagram of the power plug in accordance with the present invention. The main circuit 410 contains an input port 414 that connects to a source of DC power in the vehicle (i.e. battery) 420 and an output port 415 that connects to the electronic device 430. The input port 414 may consist of wires with terminals, a cigarette plug configuration, or any other suitable method of attaching to a motor vehicle's power distribution system. The output port 415 consists of a two conductor cable, with a mating connector, which allows for engagement to the electronic device.

The input port 414 and output port 415 are connected to the control circuit 412 through the power switch 411. The intelligent control circuit 412 is connected to switch a 413, which is activated by the button on the power plug housing illustrated in FIG. 2.

Figure 5:
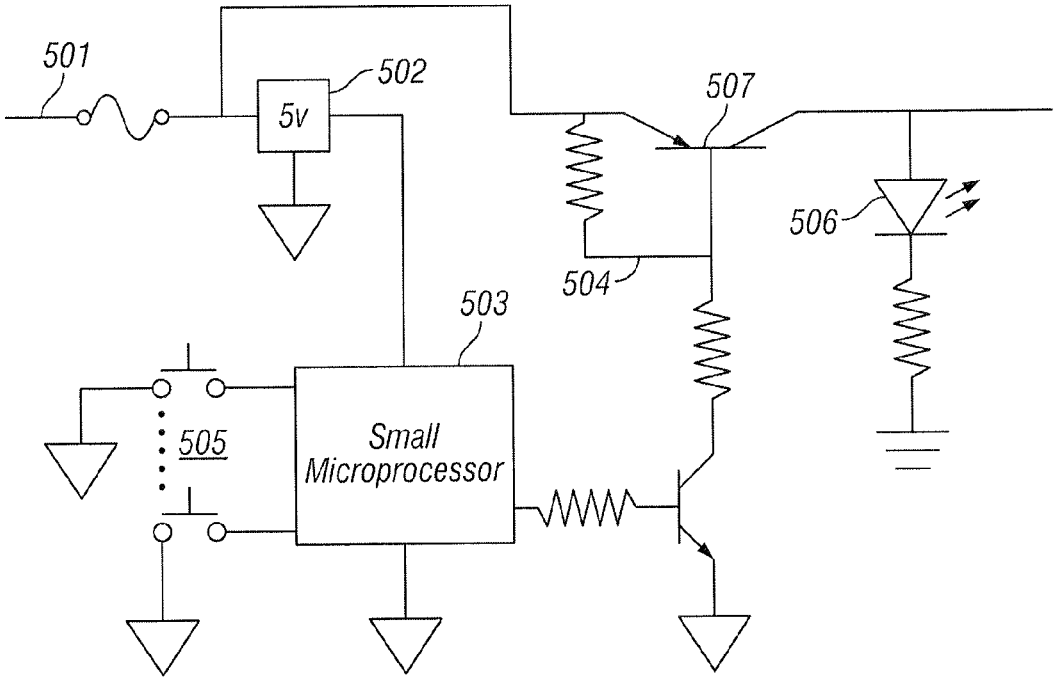
FIG. 5 is a circuit diagram illustrating one method for implementing the present invention.

FIG. 5 is a circuit diagram illustrating one method for implementing the present invention. The motor vehicle power is connected to the power input terminal 501, through the power terminals. A regulator 502 creates a suitable voltage to power the associated circuitry contained within. A small microprocessor 503 controls the output circuitry 504, based the on activation of the switches 505. The present invention may contain a power on light emitting diode (LED) and an activation LED 506.

Once activation of one of the switches 505 is detected, the microprocessor 503 causes the control circuitry to interrupt the power to the device via the series pass transistor 507. For example, a short press (e.g., ≦0.5 second) of the switch 505 may cause a single interruption of the power, while two interruptions correspond to a long press (e.g., ≧0.5 second) of the switch. However, these power interruptions are relatively short in duration (e.g., one millisecond or less).

If multiple switches are utilized, the number of interruptions, or duration of the interruptions, can be altered to distinguish which switch is activated. In such a case, the microprocessor in the detector senses the duration and/or number of interruptions and activates the function associated with the assigned pattern.

Figure 6:
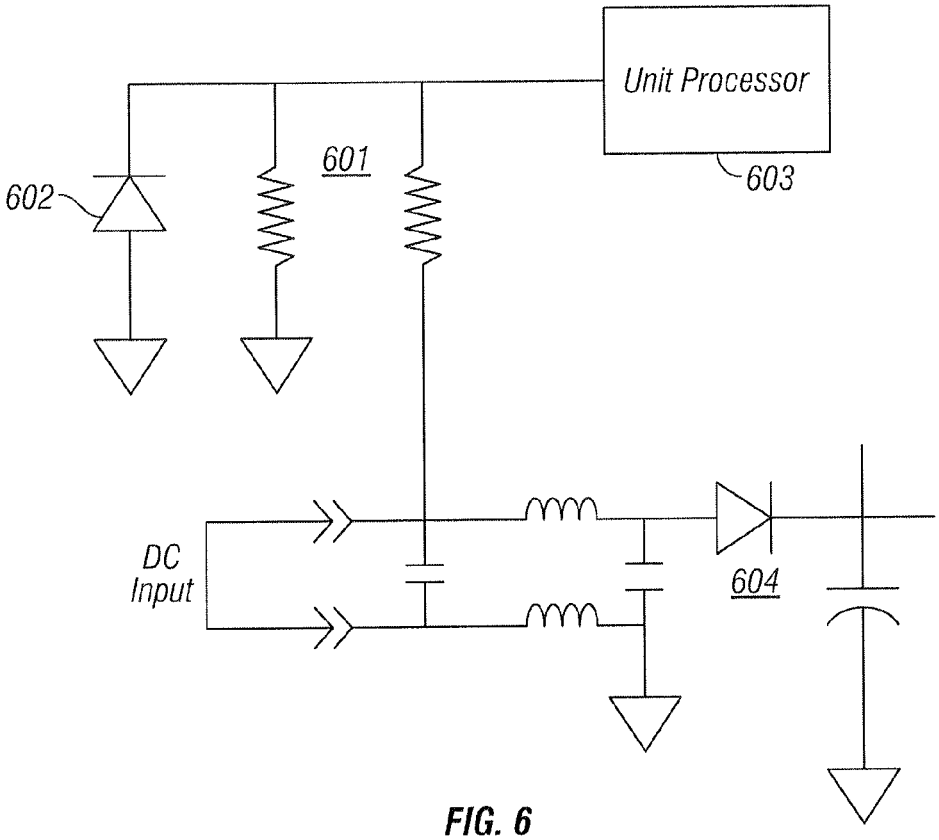
FIG. 6 is a circuit diagram illustrating the recovery of the interrupted power to the detector.

FIG. 6 is a circuit diagram illustrating the recovery of the interrupted power to the electronic device. The circuit elements consist of a resistor divider network 601 and a protection diode 602. The microprocessor 603 detects the interruption and determines its characteristics. Circuit elements 604, comprising a peak detection circuit, enables the rest of the electronic circuitry to be unaffected by the interruption.

Figure 7:
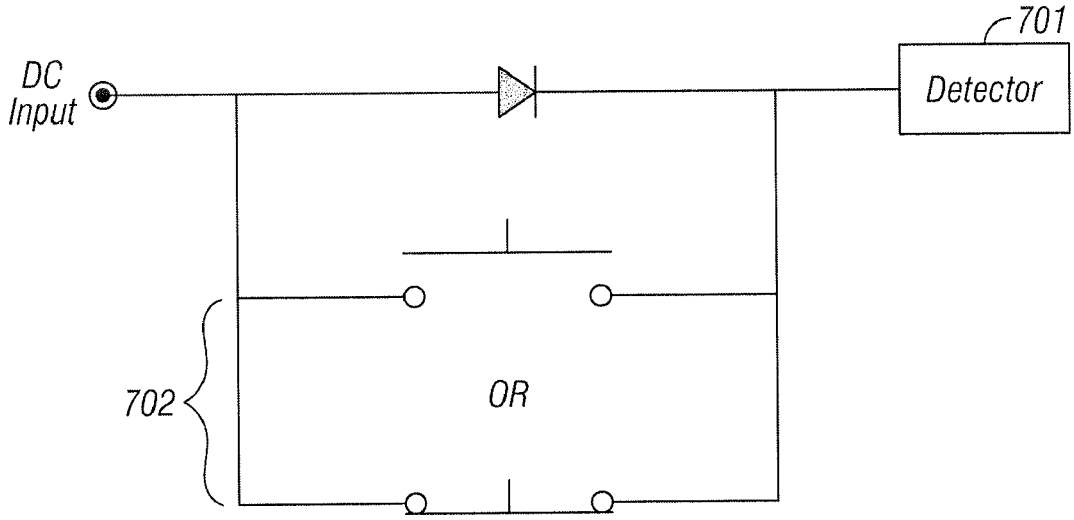
FIG. 7 is a circuit diagram illustrating the signaling of the detector when a switch has been pressed at the power distribution device.

FIG. 7 depicts another circuit diagram for signaling the detector that a switch has been pressed at the power distribution device (power plug). The voltage at the detector 701 is shifted lower when the switch 702 is activated. The level shifting of one diode drop does not affect the operation of the electronic device. The voltage shift can also be designed to increase if a normally closed switch is utilized.

Figure 8:
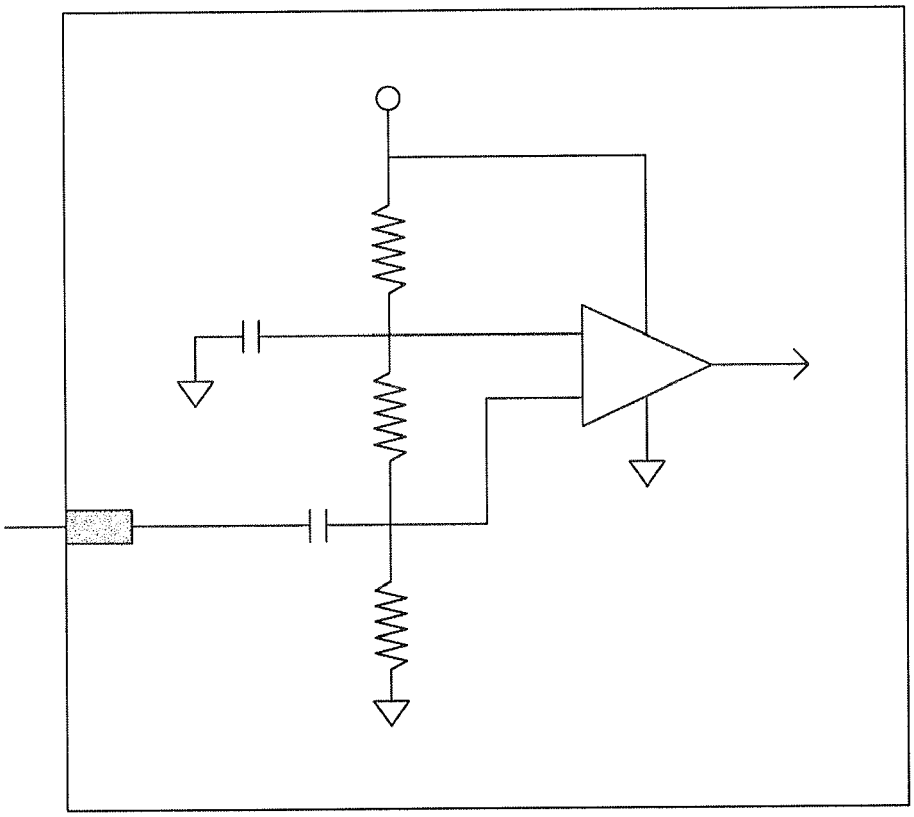
FIG. 8 depicts a typical comparator circuit for detecting voltage transition level shifting.

FIG. 8 depicts a typical comparator circuit for detecting voltage transition level shifting. As shown, the comparator output will go low when it detects an increase in voltage level. The circuit can also be reconfigured to detect a decrease in voltage level.

Figure 9:
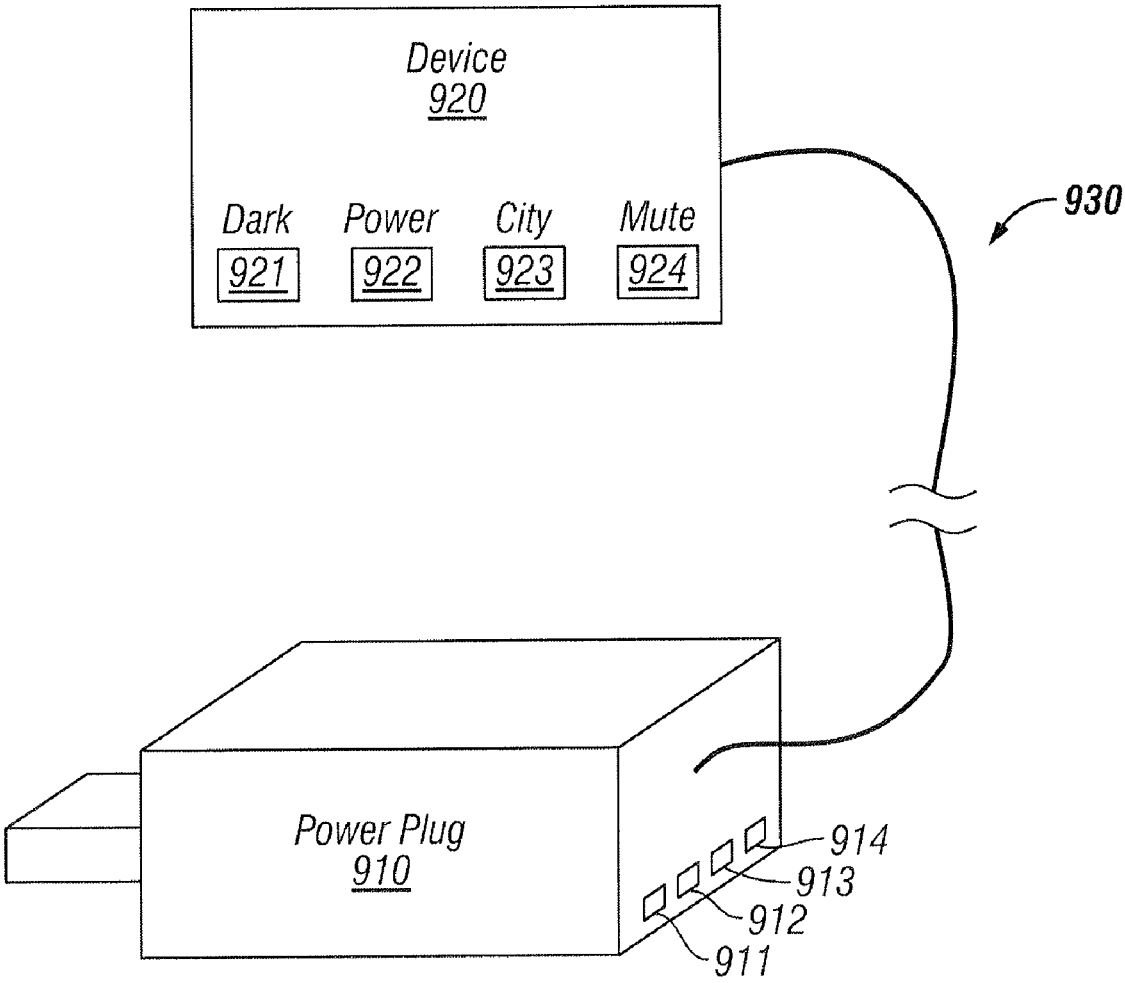
FIG. 9 shows an alternate embodiment of the present invention in which the functions of the electronic device are directly mapped to buttons on the power plug.

FIG. 9 shows an alternate embodiment of the present invention in which the functions of the electronic device are directly mapped to buttons on the power plug. In this embodiment, the functions of buttons 911-914 on the power plug 910 have dedicated assignments to the functions of the electronic device 920, represented by buttons 921-924, rather than being programmed by the user. Like previous embodiments, the one depicted in FIG. 9 also has the benefit of using a simple two-conductor cable 930.

Figure 10:
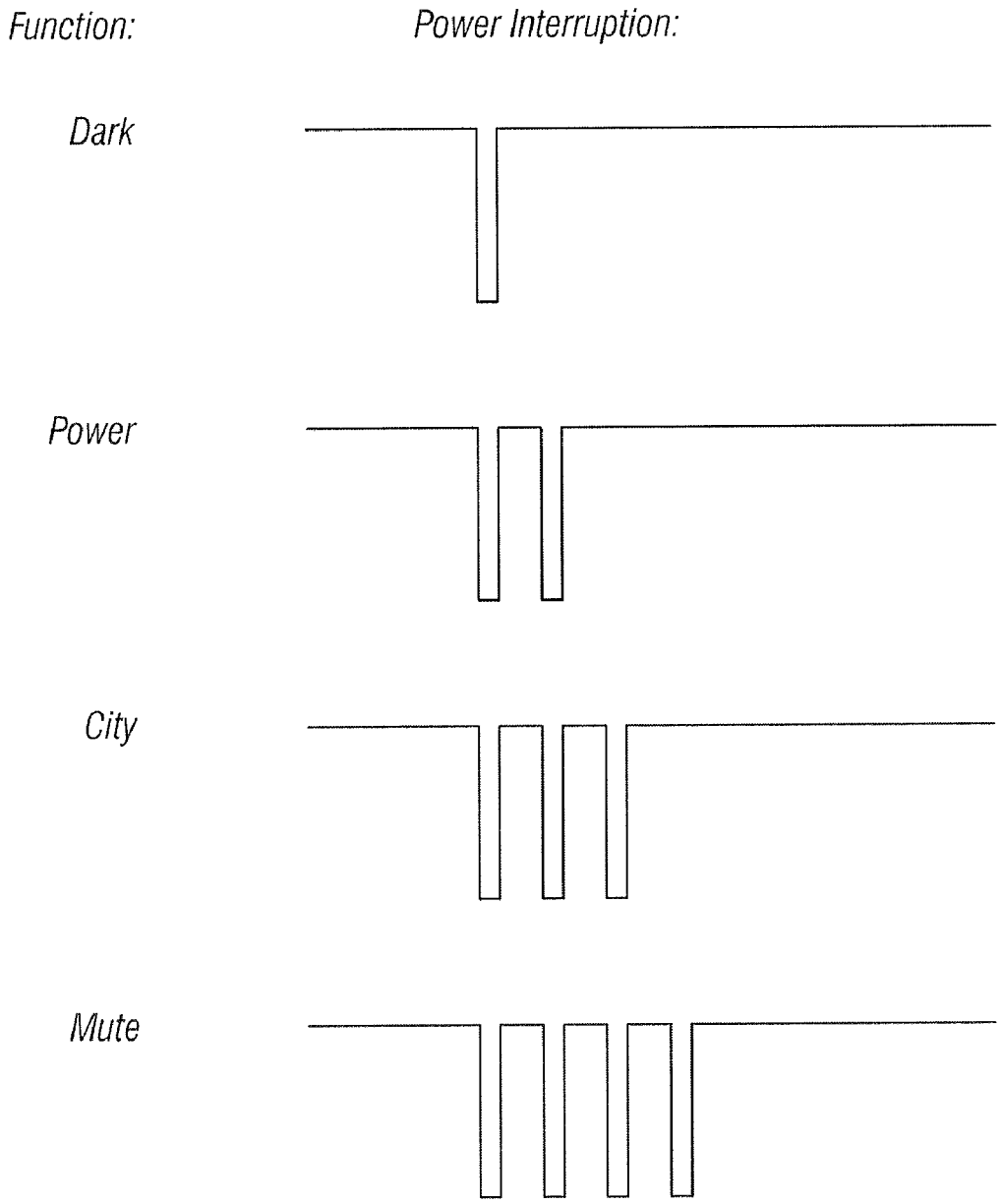
FIG. 10 shows one relationship between an assigned function on the power plug and the number of interruptions for the embodiment depicted in FIG. 9.

FIG. 10 shows one relationship between an assigned function on the power plug and the number of interruptions for the embodiment depicted in FIG. 9. Whereas the embodiments described above relate the number of interruptions to the length of the switch activation, this embodiment relates the number of interruptions to specifically assigned ("mapped") buttons. This alternate embodiment does not provide the same user flexibility as the above embodiments, but on the other hand it does provide a simpler system that may be more appropriate for electronic devices with fewer functions. In this example, the buttons on the power plug relate to the functions of a police radar detector, but again it should be emphasized that the general concept can be applied to any electronic device with multiple functions.

The description of the present invention has been presented for purposes of illustration and description, and is not intended to be exhaustive or limited to the invention in the form disclosed. Many modifications and variations will be apparent to those of ordinary skill in the art. The embodiment was chosen and described in order to best explain the principles of the invention, the practical application, and to enable others of ordinary skill in the art to understand the invention for various embodiments with various modifications as are suited to the particular use contemplated. It will be understood by one of ordinary skill in the art that numerous variations will be possible to the disclosed embodiments without going outside the scope of the invention as disclosed in the claims.

We claim:

1. A power plug for powering an electronic device, the plug comprising:

(a) a housing and electrical contacts that connect to a motor vehicle power distribution system;

(b) a power cord coupled to said housing for supplying power from said power distribution system to the electronic device; and (c) at least one switch coupled to said housing, wherein said switch controls multiple user assigned functions of said electronic device, wherein the particular function controlled by said switch depends on the length of time the switch is depressed.

2. The power plug according to claim 1, wherein said housing is adapted for insertion into a cigarette lighter socket.

3. The power plug according to claim 1, wherein a first function is controlled if the switch is depressed for less than 0.5 second.

4. The power plug according to claim 1, wherein a second function is controlled if the switch is depressed for 0.5 second or longer.

5. The power plug according to claim 1, further comprising:

an electronic circuit inside said housing that controls power to said electronic device.

6. The power plug according to claim 5, wherein switch activation results in interruption of power to the electronic device.

7. The power plug according to claim 5, wherein switch activation results in a level shift of the voltage to the electronic device in a predetermined manner.

8. The power plug according to claim 7, wherein said voltage shift is +0.7 volts.

9. The power plug according to claim 7, wherein said voltage shift is −0.7 volts.

10. The power plug according to claim 1, wherein the power cord is a two-conductor cable.

11. A power plug for powering an electronic device, the plug comprising:

(a) a housing and electrical contacts that connect to a motor vehicle power distribution system;

(b) a power cord coupled to said housing for supplying power from said power distribution system to the electronic device;

(c) at least one switch coupled to said housing, wherein said switch controls at least one user assigned function of said electronic device;

(d) an electronic circuit inside said housing that controls power to said electronic device, wherein switch activation results in interruption of power to the electronic device, and wherein a single power interruption to the electronic device corresponds to switch activation less than a specified duration.

12. The power plug according to claim 11, wherein the duration of said power interruption is one millisecond or less.

13. The power plug according to claim 11, wherein said specified duration of switch activation is 0.5 second.

14. The power plug according to claim 11, wherein two power interruptions to the electronic device correspond to switch activation equal to or greater than a specified duration.

15. The power plug according to claim 14, wherein the duration of each of said power interruptions is one millisecond or less.

16. The power plug according to claim 14, wherein said specified duration of switch activation is 0.5 second.

17. A power plug for powering an electronic device, the plug comprising:

(a) a housing and electrical contacts that connect to a motor vehicle power distribution system;

(b) a two-conductor power cord coupled to said housing for supplying power from said power distribution system to the electronic device;

(c) multiple switches coupled to said housing, wherein each switch is mapped to a specific function of said electronic device; and (d) an electronic circuit inside said housing for controlling power to said electronic device, wherein switch activation results in interruption of power to the electronic device, and wherein activation of each switch produces a unique number of power interruptions that is associated with a specified function of the electronic device.

18. The power plug according to claim 17, wherein said housing is adapted for insertion into a cigarette lighter socket.

* * * * *